US008069603B2

(12) United States Patent
Moody et al.

(10) Patent No.: US 8,069,603 B2
(45) **Date of Patent: *Dec. 6, 2011**

(54) CANTING VERTICAL FORE GRIP WITH BIPOD

(75) Inventors: Joseph R. Moody, Jacksonville, FL (US); Joseph D. Gaddini, Cape Coral, FL (US)

(73) Assignee: Grip Pod Systems, LLC, Jacksonville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/584,001

(22) Filed: Aug. 28, 2009

(65) Prior Publication Data

US 2010/0307043 A1 Dec. 9, 2010

Related U.S. Application Data

(63) Continuation-in-part of application No. 11/485,762, filed on Jul. 13, 2006, now Pat. No. 7,490,429, which is a continuation-in-part of application No. 10/725,082, filed on Dec. 2, 2003, now Pat. No. 7,111,424, application No. 12/584,001, which is a continuation-in-part of application No. 29/267,729, filed on Oct. 20, 2006, now Pat. No. Des. 556,220, which is a continuation-in-part of application No. 29/259,347, filed on May 5, 2006, now Pat. No. Des. 566,219.

(51) Int. Cl.
*F41C 23/00* (2006.01)

(52) U.S. Cl. ..... 42/72; 42/94; 248/171

(58) Field of Classification Search ..... 42/72, 94; 248/171

See application file for complete search history.

(56) References Cited

U.S. PATENT DOCUMENTS

| | | | |
|---|---|---|---|
| 271,251 | A | 1/1883 | Leerbech et al. |
| 575,529 | A | 1/1897 | Stephens |
| 583,656 | A | 6/1897 | McGrady |
| 713,114 | A | 11/1902 | Force |
| 721,425 | A | 2/1903 | Clyde |
| 1,295,688 | A | 2/1919 | Butler |
| 1,355,660 | A | 10/1920 | Farquhar et al. |
| 1,382,409 | A | 6/1921 | Butler |
| 1,580,406 | A | 4/1926 | Browning |
| 2,386,802 | A | 10/1945 | Johnson |

(Continued)

OTHER PUBLICATIONS

Gun Accessories (by weapon), [online] MSP Mounting Solutions Plus, mountsplus.com, Grip Pod GPA 01-Black/Plymer The Grip Pod System (CPA), 6 pages, [retrieved on Mar. 19, 2008] Retrieved from: https://www.mountplus.com/thestore/65_other.html.

(Continued)

*Primary Examiner* — Michelle Clement

(74) *Attorney, Agent, or Firm* — Brian S. Steinberger; Law Offices of Brian S. Steinberger, P.A.

(57) ABSTRACT

Devices, systems and methods of canting firearms such as rifles relative to fore grip having extendable and expanded legs. One version allows for a rocking and canting of the firearm by pivotally attaching an upper portion of the expanded legs. Another version allows for a separate canting member to be clamped to both the upper portion of a vertical fore grip and to the lower mounting rail of the firearm. The canting member has portions that cant (move to the left or to the right) relative to one another. An operator can cant the firearm in a free-state or to fixed positions as desired.

15 Claims, 15 Drawing Sheets

U.S. PATENT DOCUMENTS

| | | | | |
|---|---|---|---|---|
| 2,420,267 | A | | 5/1947 | Sefired |
| 2,436,349 | A | | 2/1948 | Adams |
| 2,472,804 | A | | 6/1949 | Bird |
| 2,489,283 | A | | 11/1949 | Garand |
| 2,763,456 | A | | 9/1956 | Breer |
| 2,807,904 | A | | 10/1957 | Kreske |
| 2,898,137 | A | | 8/1959 | Kreske |
| 2,991,579 | A | | 7/1961 | Lies |
| 3,235,997 | A | | 2/1966 | Stoner |
| D222,118 | S | | 9/1971 | Nakatani |
| 3,632,073 | A | | 1/1972 | Nakatani |
| 4,121,799 | A | | 10/1978 | Michio |
| 4,545,660 | A | | 10/1985 | Rudolf |
| 4,776,124 | A | | 10/1988 | Clifton |
| 4,807,837 | A | | 2/1989 | Gawlik et al. |
| 4,903,425 | A | * | 2/1990 | Harris ..... 42/94 |
| 5,029,407 | A | | 7/1991 | Kirkpatrick |
| 5,074,188 | A | | 12/1991 | Harris |
| 5,081,478 | A | | 1/1992 | Hayashida et al. |
| 5,194,678 | A | | 3/1993 | Kramer |
| 5,345,706 | A | | 9/1994 | Brown |
| 5,384,609 | A | | 1/1995 | Ogawa et al. |
| 5,438,786 | A | | 8/1995 | Hilderbrand |
| 5,711,103 | A | | 1/1998 | Keng |
| 5,815,974 | A | | 10/1998 | Keng |
| 6,289,622 | B1 | | 9/2001 | Desch, Jr. et al. |
| 6,487,807 | B1 | | 12/2002 | Kopman et al. |
| 6,539,660 | B1 | | 4/2003 | Yeargin |
| 6,827,319 | B2 | | 12/2004 | Mayr |
| 6,843,015 | B2 | | 1/2005 | Sharp |
| 7,111,424 | B1 | | 9/2006 | Moody et al. |
| 7,143,986 | B1 | | 12/2006 | Austin et al. |
| 7,290,740 | B2 | | 11/2007 | Joy et al. |
| 2003/0192223 | A1 | | 10/2003 | Sharp |
| 2004/0060222 | A1 | | 4/2004 | Oz |
| 2005/0188588 | A1 | | 9/2005 | Keng |
| 2005/0241206 | A1 | | 11/2005 | Teetzel et al. |
| 2005/0242250 | A1 | | 11/2005 | Keng |
| 2006/0191183 | A1 | | 8/2006 | Griffin |
| 2006/0277809 | A1 | | 12/2006 | Moody et al. |
| 2007/0079541 | A1 | | 4/2007 | Peterson |

OTHER PUBLICATIONS

GunsAmerica—Rock Creek Barrels SOPMOD Raptor Bipod—Gun Parts-Ri . . . , [online] Classified Ad, Rock Creek Barrels SOPMOD Raptor Bipod, 2 pages, [retrieved on Mar. 19, 2008] Retrieved From: http://www.gunsamerica.com/976892854/Non-Guns/Gun-Parts-Rifle-Accuracy-Sniper/RO....

Ghillie Suit Rail Intervace System, [online] Ghillie Suits—ar—15 Rifle.., Pistol Grips, Handgun Grips & Revolver and Gun Grips Blog Archive, Rifle Bipod, blog written Mar. 11, 2008, 2 pages, [retrieved on Mar. 19, 2008] Retrieved From: http://ghillierailintervacesystem.blogspot.com/.

Versa-Pod New Short Prone Bipod w/Spring-Activated Legs, [online] The Shooters Box.com, 2 pages, [retrieved on Mar. 19, 2008] retrieved From: http://www.theshooterbox.com/store/index.php?main_page=product_info&products_id=9....

Current "AR Deals" . . . [online] Questar International, AR Deal Items, updated Mar. 2, 2008, 2 pages, [retreived on Mar. 19, 2008] Retrieved From: http://www.questar.ca/deals/ar_deals/ar_deas.htm.

Versa-Pod Bipods, [online] Gunaccessories.com, Versa-Pod Bipods, Phone Position Bipods, 4 pages, [retrieved on Mar. 19, 2008] Retrieved From: http://www.gunaccesspries.com/versaPod/default.asp.

Israel Defense Forces rifle accessories and improvements, [online] Israel Defence Forces rifle accessories and improvments made by Warriors for Warriors, Canted Ergonomic For grip, Pistol Grip, Folding Pistol Grip, T-Pod Tactical grip, and bipod, 6 pages, [retrieved on Mar. 19, 2008] Retrieved From: http://www.zahal.org/rifile/.

Firearm Accessories, Gemtech For the 21st Century, [online] Custom Accessories, Available, Vertical Foregrip Replacement Center Core, 2 pages, [retieved on Mar. 19, 2008] Retrieved From: http://srtestore.com/FirearmAccess.pdf.

FAB Defense.com, Canted to reduce kick, the vertical grip is intended to serve an added comfort, accuracy . . . 10 pages. [retreived on Mar. 19, 2008] Retrieved From: http://www.fab-defencse.com/fab_Catalog.pdf—similar pages.

Battenfeld Technologies, Inc., [online] 2005 catalog, Caldwell Shooting Supplies, Muley-pod, Caldwell Bipods, 3 pages, [Retrieved on Mar. 19, 2008] Retrieved From: http://www.battenfeld-technologies.com/bettenfeldcatalog05.pdf—similar pages.

Brugger & Thomet Unipod, Forward grip with retractable bipod, [online] DSA Inc. Systems Second to None, DSA Order Center, 1 Page, [Retrieved on Oct. 17, 2006] Retrieved From: http://www.dsarms.com/item-detail.cfm?ID=BT21830A &storeid=1image=bt21830A.gif.

Denis H.R. Archer, M.A., "Jane's Infantry Weapons" 1976, pp. 1-3 .

* cited by examiner 20
22
30
40
50
60
90°
110
120
32
70
80
90
100
36

Fig.8
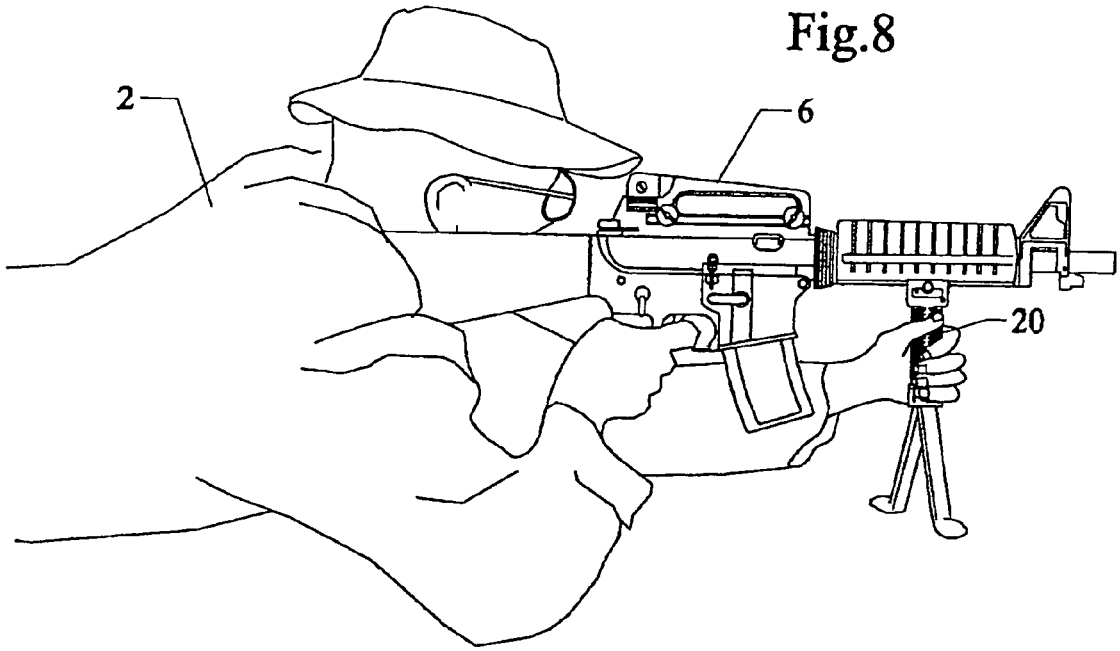
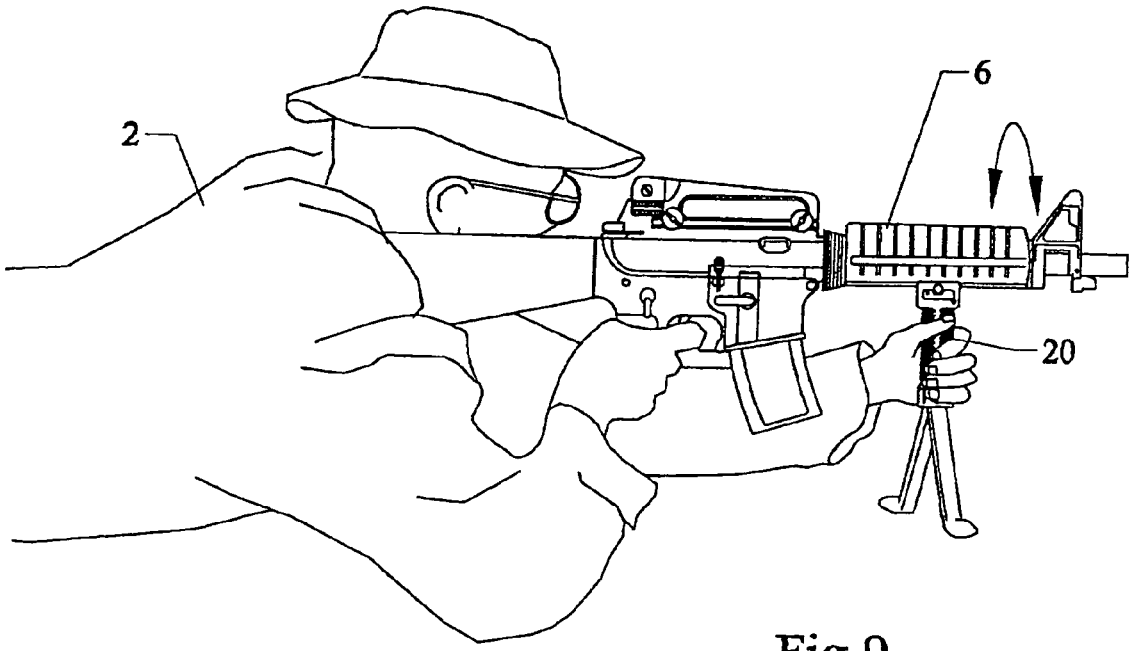
Fig.9

200
210
200

150
T
R
210
230
180
190
230
B
170
L 200
160
220
180
210

200
200

170
220
160
200

Fig.30
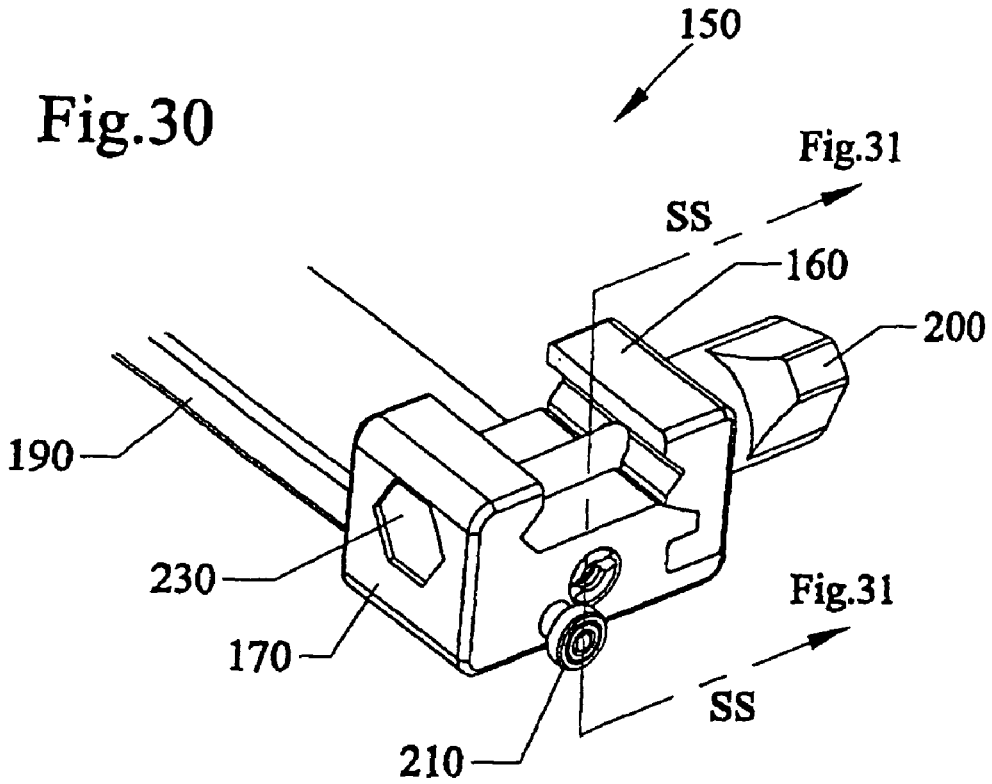
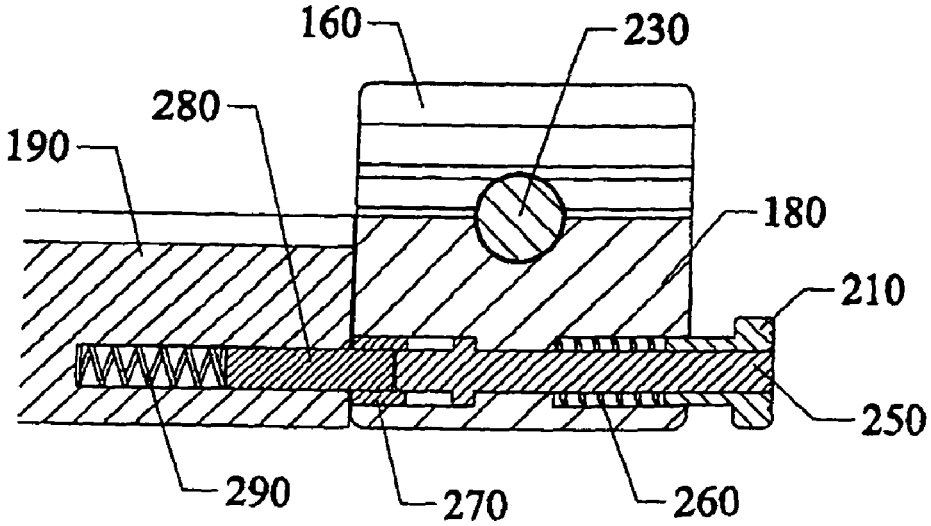
Fig.31

Fig.32
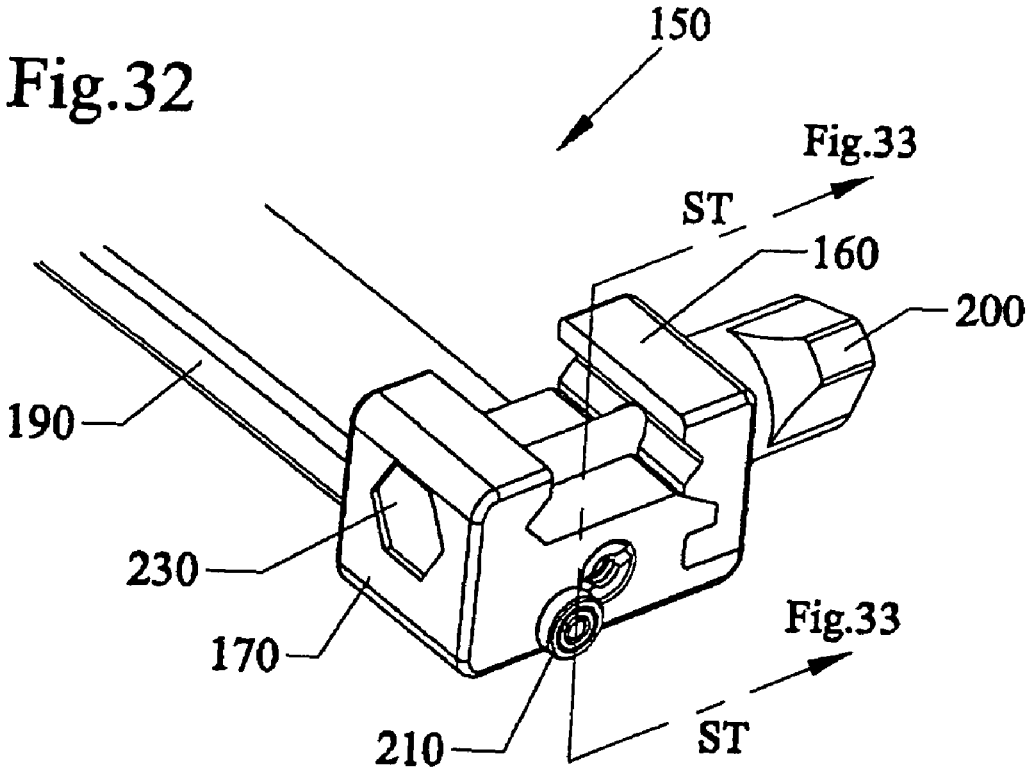
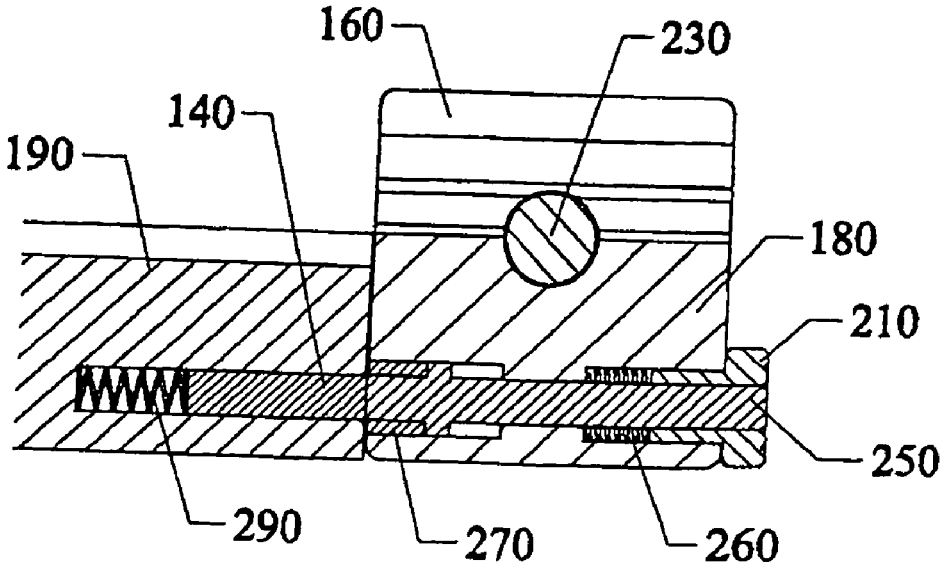
Fig.33

CANTING VERTICAL FORE GRIP WITH BIPOD

This invention is a continuation in part of U.S. patent application Ser. No. 11/485,762 filed Jul. 13, 2006, which is a Continuation-In-Part of U.S. patent application Ser. No. 10/725,082 filed Dec. 2, 2003, now U.S. Pat. No. 7,111,424, and is a Continuation-In-Part of U.S. Design patent application Ser. No. 29/267,729 filed Oct. 20, 2006 which is a divisional of U.S. Design patent application 29/259,347 filed May 5, 2006.

FIELD OF THE INVENTION

The present invention relates to guns and more particularly to cantering devices, apparatus, systems and methods of allowing a firearm to cant (move to the left and the right) relative to a support stand such as a fore grip/gun handle with a pistol grip having a concealable and collapsible bipod.

BACKGROUND AND PRIOR ART

Over the years, there has been considerable prior art for bipod devices, that date back to pre-20$^{th}$ century times, with bipods having a familiar appearance, structure and configuration.

For example, the known prior art includes but is not limited to U.S. Pat. Nos. 271,251; 1,295,688; 1,355,660; 1,382,409; 1,580,406; 2,386,802; 2,420,267; 2,436,349, and 3,235,997. These patents disclose the respective art in relation to bipods, but do not disclose a fore grip or gun handle with a concealable and collapsible bipod.

U.S. Pat. No. 6,487,807 describes a tripod gun handle that provides a combination pistol grip and pivotal tripod. An examination of this patent reveals a number of problems with this device, and the most obvious problem is that the tripod legs are positioned on the exterior of the handle when not deployed. If the gun with this device attached was being used in wet or muddy environments, either in a deployed or storage position, the ingress of mud and dirt into and around the handle could result in the deployment and storage of the tripod legs being severely restricted due to the mud or foreign matter. Another problem is that deployment requires the rotation of a disengagement cam to force the legs into their deployed position and then a leg locking assembly is rotated to lock the legs into a locked position. Two separate actions are required to deploy and lock the tripod legs into a locked position.

A problem with these bipods and leg stands is that the stands are generally locked in a fixed position, which means an operator would have to physically move the entire stand such as cant, tilt and/or physically raise the stand to adjust firearm to fire a shot. Such physical movements of having to physically cant, tilt and/or lift the stand would be naturally uncomfortable to the operator. In addition such physical movements can cause the firearm to be forced to be held in an unsteady position were it is difficult and potentially impossible to be able to fire a reliable shot at an intended target.

The inventors of the subject invention have to date patented at least one U.S. Pat. No. 7,111,424 to Gaddini. This patent includes a replaceable mounting assembly that allows for mounting of the gun handle by various means to a gun. A fore grip or gun handle, designed with ergonomic reasons in mind, provides a stable means of holding the gun. A plurality of legs that are concealed within the fore grip are coupled via a hinge to a spring piston assembly. A spring-loaded fulcrum release mechanism holds the piston assembly in a compressed and locked position. When the piston assembly is released upon activation of the spring-loaded fulcrum release mechanism, the legs are driven downwards by the piston and upon being released from the confinement of the fore grip are deployed outwards to a locked position by a hinge or pivot mechanism. The legs have feet that are designed so that, when the legs are concealed within the handle, the feet seal off the deployment and spreader mechanisms from entrance of any debris, material etc that may interfere with the deployment of the bipod.

The novel invention allows stands such as bipods to be able to cant (movel to the left or right) as desired by the firearm operator.

SUMMARY OF THE INVENTION

A primary objective of the subject invention is to provide a canting fore grip/gun handle that combines a pistol grip and a concealable and collapsible bipod, wherein the firearm can cant (move to the left and right) relative to the top of fore/grip handle above the deployed bipod.

A secondary objective of the subject invention is to provide a canting fore grip/gun handle that combines a pistol grip and a concealable and collapsible bipod, wherein the firearm and the fore/grip handle can cant (move to the left and right) relative to the deployed bipod.

A third objective of the subject invention is to provide a universal mounting head for allowing a firearm to be able to cant (move to the left or right) above a fore grip/gun handle.

A fourth objective of the subject invention is to provide a universal mounting head for allowing a firearm to be able to cant (move to the left or right) above a bipod.

A fifth objective of the subject invention is to provide a canting device, apparatus, system and method for allowing a firearm to be able to cant (move to the left or right) relative to a support stand.

The novel invention encompasses devices, apparatus, systems and methods for canting firearms. The embodiments allow for the firearm(s) to be able to cant (move and lean to the left and to the right) when the firearm is supported by a fore grip and stand, such as a fore grip with a collapsible and concealable bipod.

A canting fore grip for mounting to a firearm such as but not limited to a rifle, can include an elongated vertical fore grip having an upper end for mounting to the firearm, and a lower end, expandable legs that extend out from beneath the lower end of the fore grip, the legs for supporting the firearm above a surface, and a canting member for allowing the firearm to cant to the right and the left relative to the surface on which the firearm is supported.

The canting member can have stops for allowing right canting up to approximately 10 degrees and left canting to approximately ten degrees to the left.

The vertical fore grip can include a clamp for clamping a bottom portion of the firearm to an upper end of the elongated vertical fore grip. The clamp can be a screwable component for allowing the clamp to contract about the bottom portion of the firearm.

The legs can be a consealable and collapsible bipod that retract into the fore grip.

One version of the canting member can be a pivoting type member for allowing an upper portion of the legs to can to the right and to the left relative to the bottom end of the elongated vertical fore grip. The pivoting member can be a slidable ball yoke that can slide relative to a cone shaped opening. The pivoting member can include an upper triangular configuration of the legs which pivots within a cone shaped opening formed in the bottom of the elongated vertical fore grip. The cone shaped opening in the bottom of the elongated vertical fore grip can include a screwable bottom cap on the fore grip.

Another canting member can include an upper mount member for allowing the firearm to cant relative to the legs on which the firearm is supported. The upper mount member can include an upper clamp for darning the upper mount member to a firearm mounting rail, and a lower clamp for clamping the upper mount member to an upper portion of the fore grip. The upper mount member can include a tilt rail that is clamped by the upper portion of the fore grip. The upper mount member can include a spring biased tilt rail having a spring member that springably supports the firearm in a vertical upright and noncanting position.

Additionally, a spring biased button can be included that when expanded locks the firearm in a vertical upright and non canting position, and depressing the button allows the firearm to cant to the right and to the left relative to the legs.

Novel methods of canting a firearm weapon on a support stand, can include the steps of mounting a firearm to expanded legs, and canting the firearm to the right and to the left relative to the legs. The mounting step can include the step of mounting the firearm to a vertical fore grip having expandable legs.

The canting step can allow for rocking the firearm up to approximately ten degrees to the right and up to approximately ten degrees to the left.

The canting step can be accomplished pivoting an upper portion of the expandable legs within a lower opening of the fore grip.

The canting step can also be accomplished by clamping an upper member to a top portion of the fore grip and to a lower mounting rail on the firearm, and pivoting a portion of the clamped upper member relative to another portion of the clamped upper member Further objects and advantages of this invention will be apparent from the following detailed description of a presently preferred embodiment, which is illustrated in the accompanying flow charts and drawings.

BRIEF DESCRIPTION OF THE FIGURES

Ball Seat Canting Fore Grip

FIG. 8 is a side view of the operator with firearm and fore grip handle in a stationary none canting position.

FIG. 9 is another side view of FIG. 8 showing the fore grip handle in canting positions.

Stacking Plate Canting Unit

Figure 13:
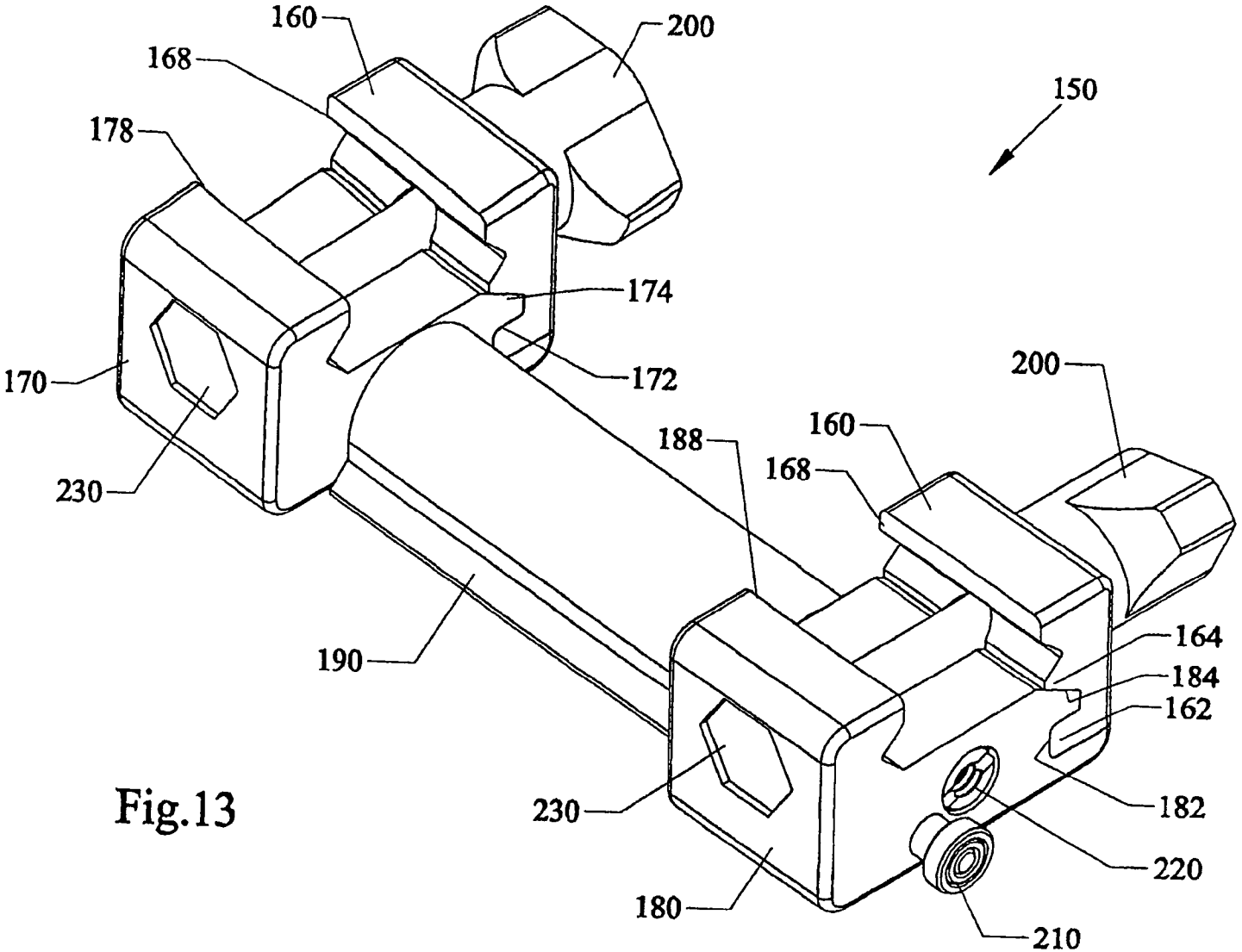

FIG. 13 is a top perspective view of a stacking canting plate for the fore grip.

Figures 14, 15, 16, 17, 18:
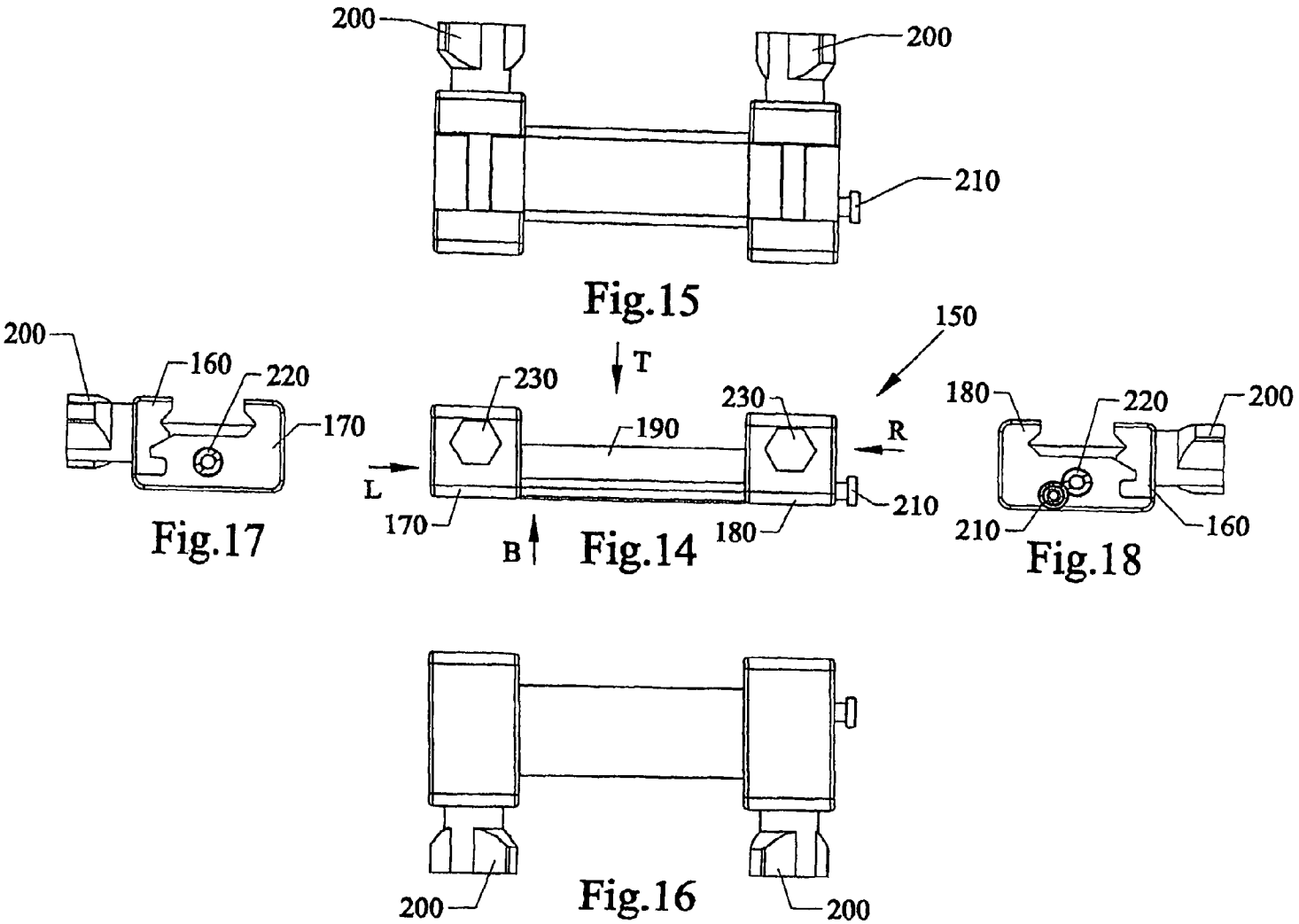

FIG. 14 is a front view of the stacking canting plate of FIG. 13.

FIG. 15 is a top view of the stacking canting plate of FIG. 13 along arrow T.

Figure 1:
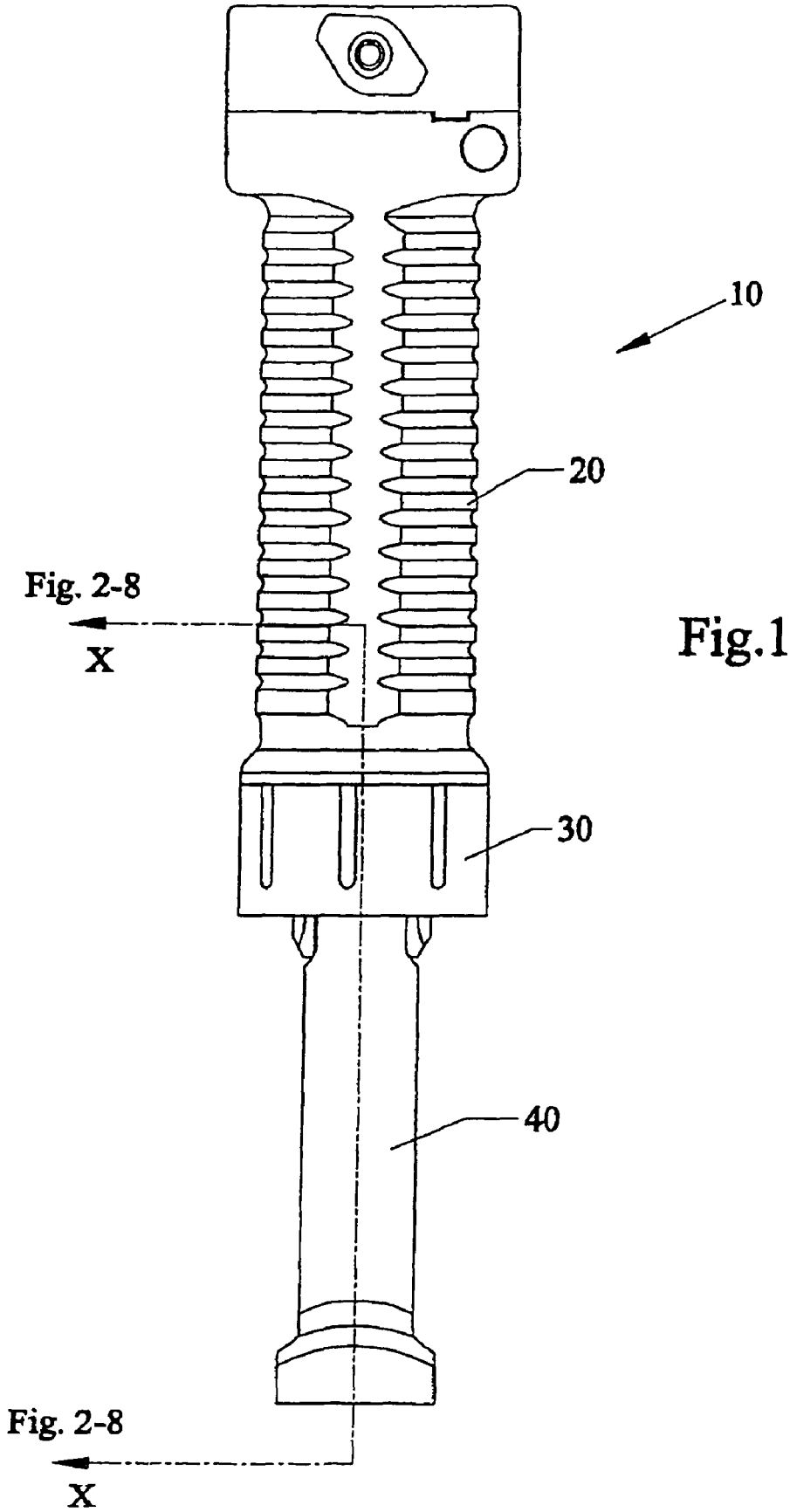
FIG. 1 is a right side view of a ball canting fore grip handle with legs extended.

FIG. 16 is a bottom view of the stacking canting plate of FIG. 1 along arrow B.

FIG. 17 is a left side view of the stacking canting plate of FIG. 13 along arrow L.

FIG. 18 is a right side view of the stacking canting plate of FIG. 13 along arrow R.

Figure 19:
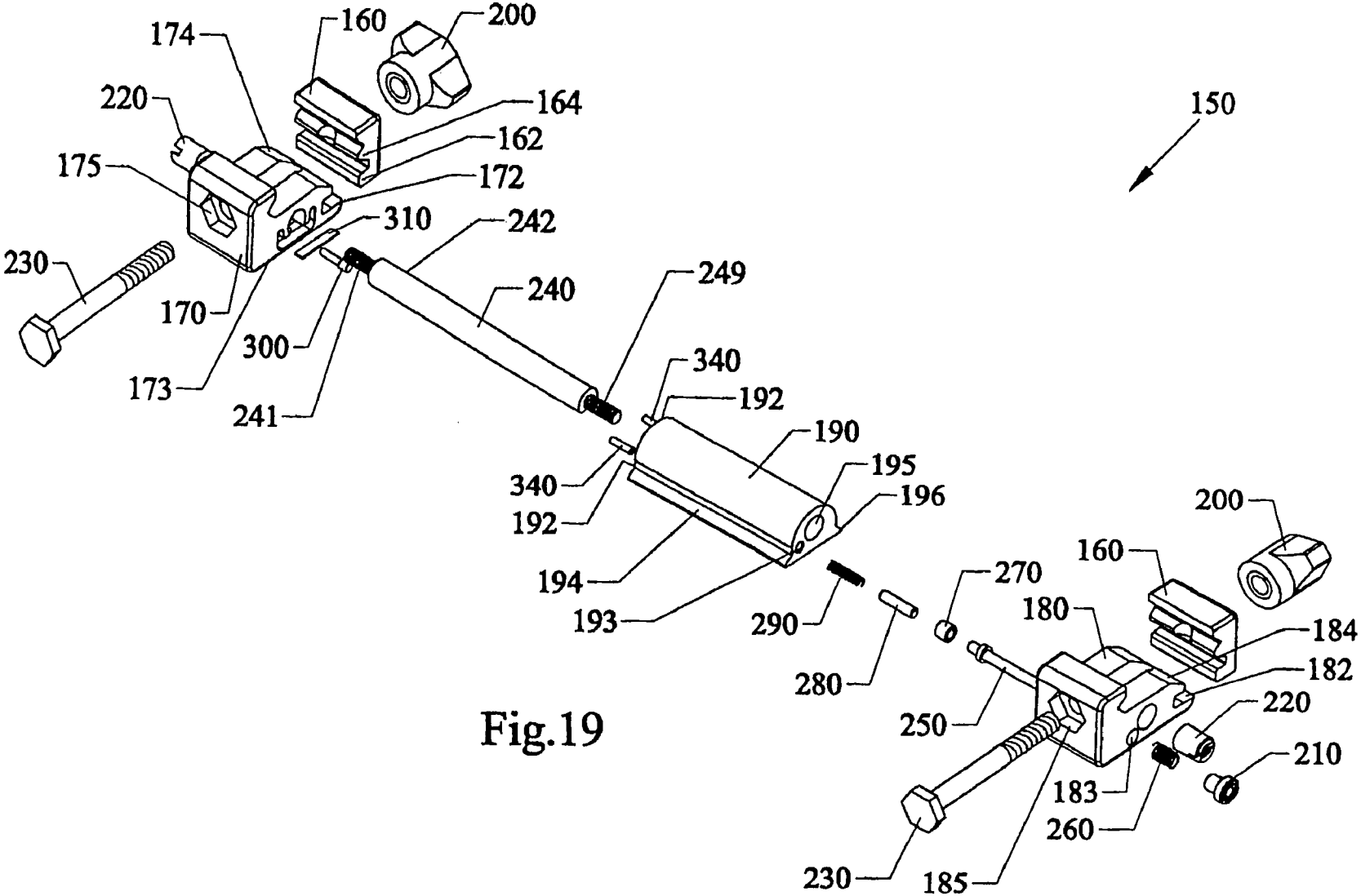

FIG. 19 is an exploded perspective view of the stacking canting plate of FIG. 13.

Figure 20:
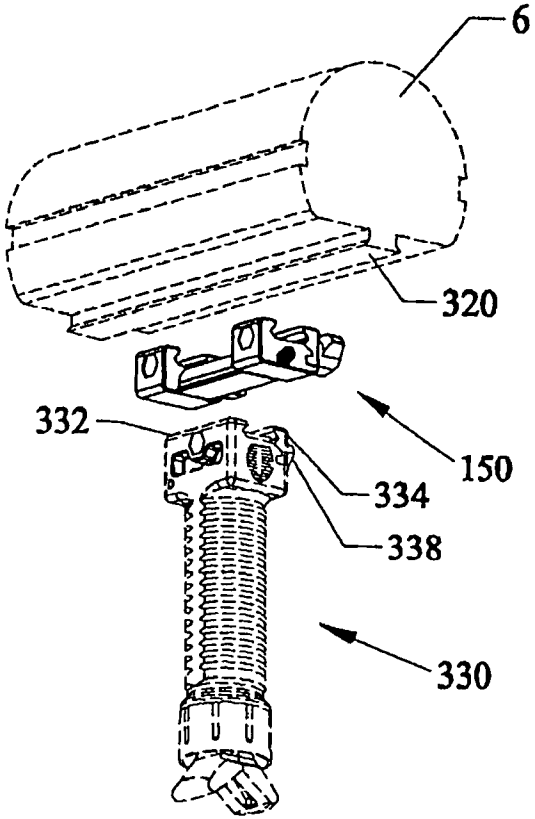

FIG. 20 is an exploded perspective view of a firearm lower rail separated from both the stacking canting plate and the fore grip.

Figure 21:
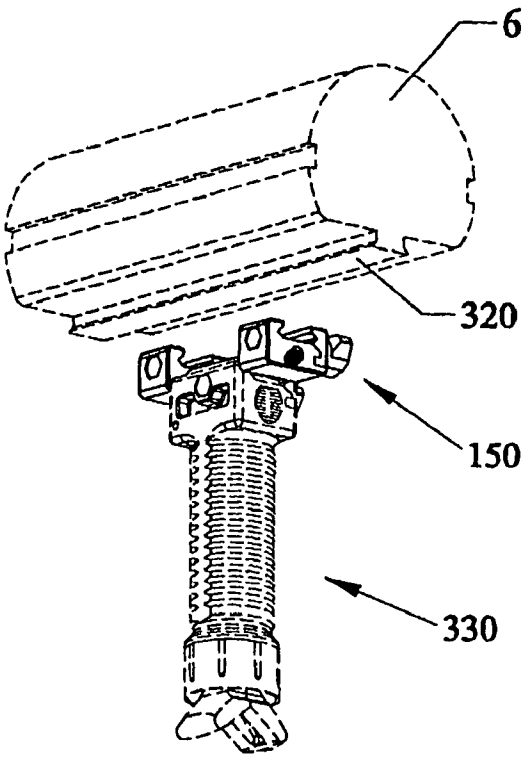

FIG. 21 is another perspective view of the fore grip clamped to the stacking canting plate, which are separated from the firearm lower rail.

Figure 22:
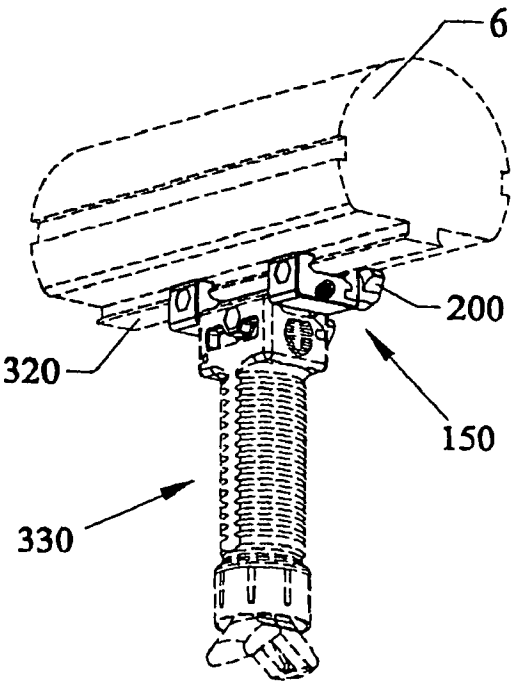

FIG. 22 is a perspective assembled view of the stacking canting plate clamped to both the firearm lower rail and the fore grip.

Figure 23:
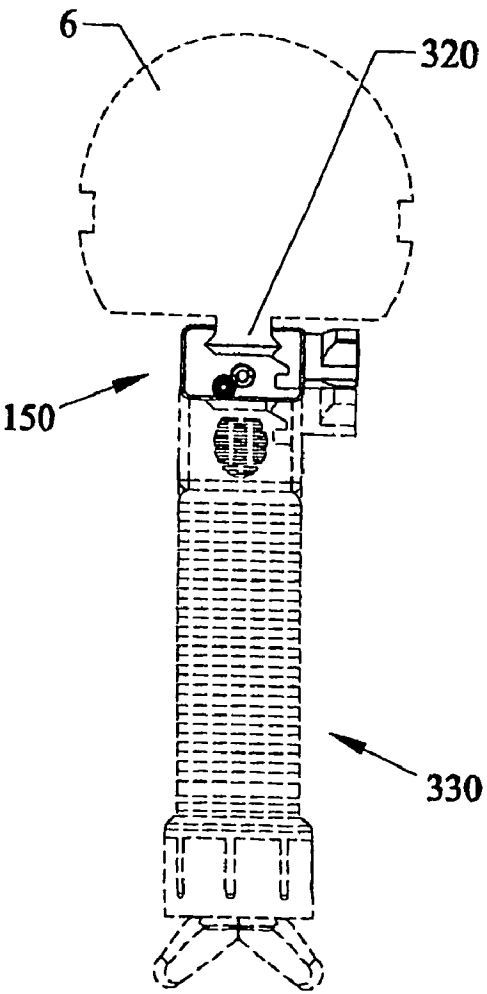

FIG. 23 is an end view of the assembled stacking canting plate and firearm lower rail and fore grip of FIG. 22 in a vertical (neutral) position.

Figure 24:
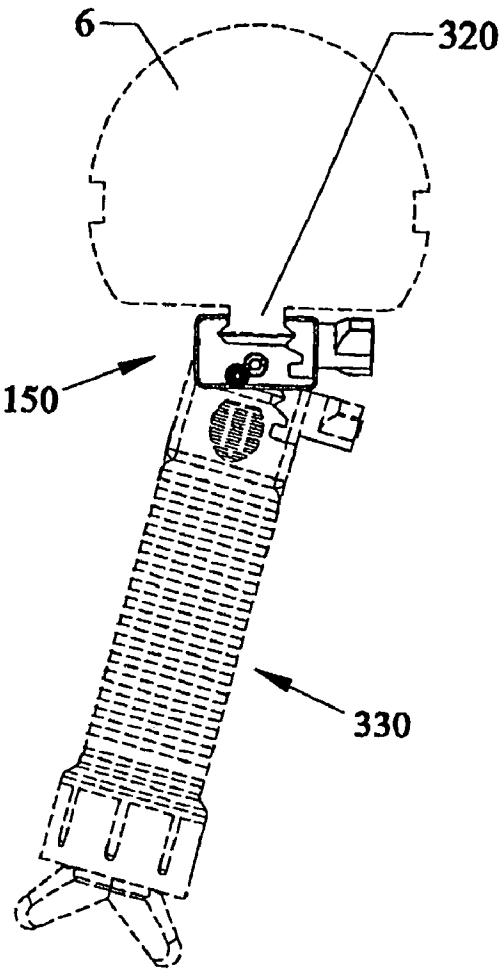

FIG. 24 is another end view of the assembled stacking canting plate and firearm lower rail and fore grip of FIG. 22 with the firearm canting to the left.

Figure 25:
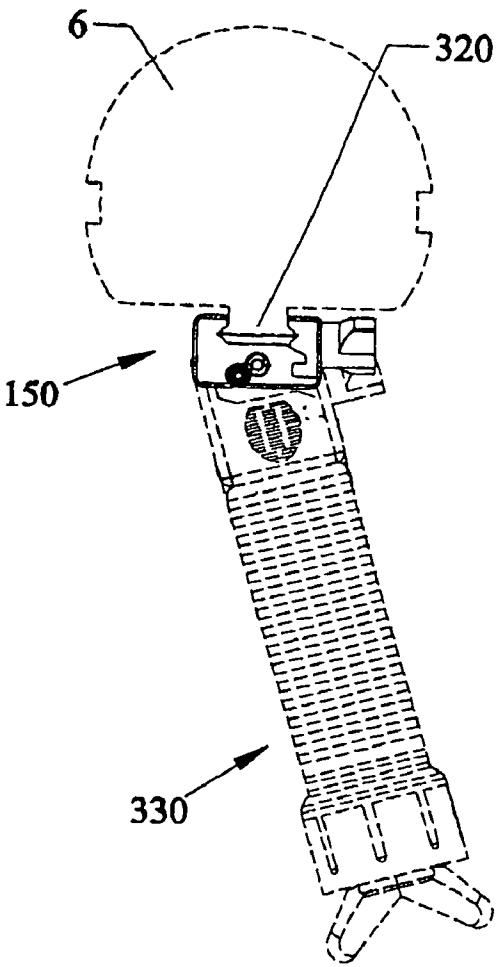

FIG. 25 is another end view of the assembled stacking canting plate and firearm lower rail and fore grip of FIG. 22 with the firearm canting to the right.

Figure 26:
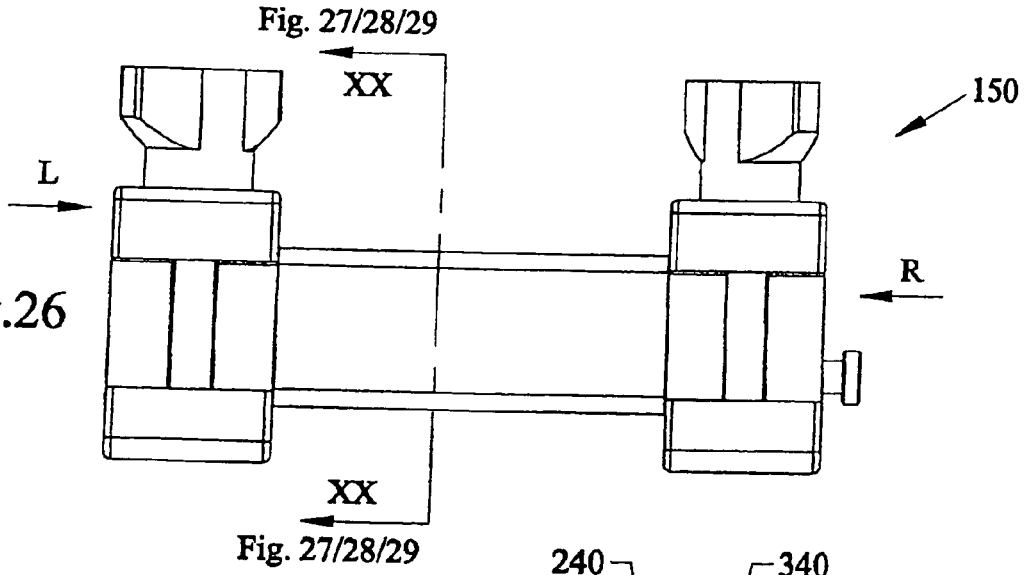

FIG. 26 is another top view of an enlarged stacking canting plate of FIG. 15.

Figure 27:
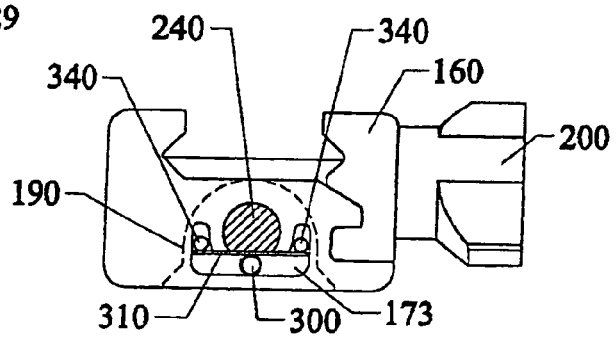

FIG. 27 is a cross-sectional right side view of the stacking canting plate of FIG. 26 along arrows XX when the firearm of FIG. 23 is in a vertical (neutral) position.

Figure 28:
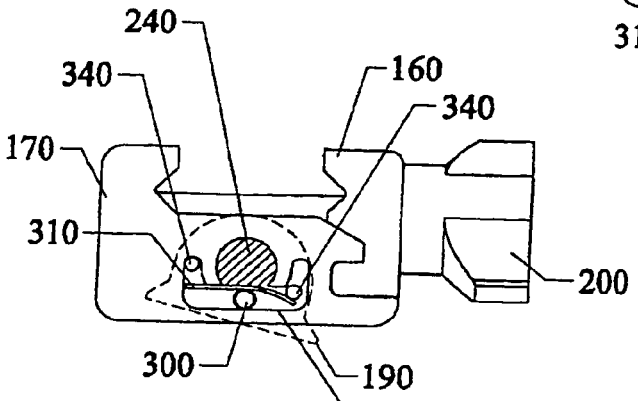

FIG. 28 is another cross-sectional right side view of the stacking canting plate of FIG. 26 when the firearm of FIG. 24 is canting to the left.

Figure 29:
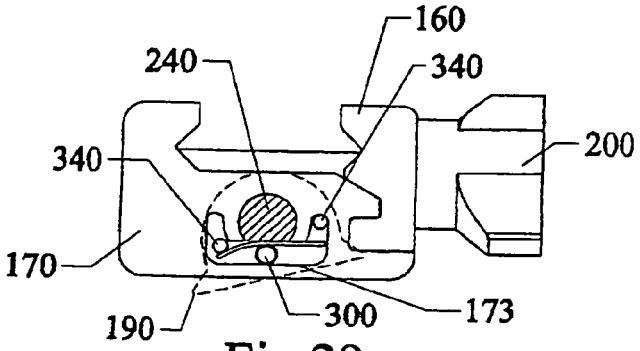

FIG. 29 is another cross-sectional right side view of the stacking canting plate of FIG. 26 when the firearm of FIG. 25 is canting to the right.

FIG. 30 is a partial upper right cross-sectional view of the stacking canting plate of the preceding figures with cant release button in an extended out canting-lock position.

FIG. 31 is a cross-sectional view of the partial stacking canting plate of FIG. 30 along arrows SS.

FIG. 32 is a partial upper right cross-sectional view of the stacking canting plate of FIG. 30 with cant release button in a depressed canting-release position.

FIG. 33 is a cross-sectional view of the partial stacking canting plate of FIG. 32 along arrows ST.

DESCRIPTION OF THE PREFERRED EMBODIMENT

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

The invention is a continuation in part of U.S. patent application Ser. No. 11/485,762 filed Jul. 13, 2006, which is a Continuation-In-Part of U.S. patent application Ser. No. 10/725,082 filed Dec. 2, 2003, now U.S. Pat. No. 7,111,424, and is a Continuation-In-Part of U.S. Design patent application Ser. No. 29/267,729 filed Oct. 20, 2006 which is a divisional of U.S. Design patent application 29/259,347 filed May 5, 2006, all of which are incorporated by reference.

The invention can use the fore grips that were described and shown in reference to the parent and copending inventions. For example, a plurality of legs can be concealed within the fore grip or gun handle and is coupled to a sliding piston assembly that is also concealed within the handle. A catch system that protrudes from the sliding piston assembly is attached to the sliding piston assembly and interfaces with a spring-loaded fulcrum release mechanism positioned at the top of the handle. A cutout within the top of the handle provides a housing for the release mechanism. A compression spring can be positioned between the sliding piston assembly and the bottom of the first cylindrical cutout and this spring, when under expansion, drives the sliding piston assembly downward toward the bottom of the fore grip. At the bottom of the fore grip, a recessed locking ring or plug is secured by threads into the fore grip, and is positioned to prevent the sliding piston assembly from over-travel and thus exiting the fore grip. The legs are connected to the bottom of the piston via a hinge or pivot point, and when the legs are released from confinement within the fore grip, the legs expand outwards until fully deployed.

Another fore grip can be an ergonomic fore grip for mounting to a firearm to stabilize the firearm, that has a top end and a bottom end with an opening there through, a mount for attaching the top end of the fore grip to a firearm, a pair of legs having an upper hinged end and a bottom end, a catch member that holding the legs in a closed position substantially inside the fore grip, a switch for releasing the catch member and allowing the bottom end to slide out from the opening in the fore grip, and an expansion spring positioned between the legs for causing the legs to pivot outward relative to the hinged end so that the legs expand outward in a triangular configuration.

This fore grip can include a generally cylindrical handle with a stacked configuration of grooves and elongated vertical flat surface edges on opposite sides of the handle. The switch can be a flush mounted button with a serrated face. The switch can be a recess mounted button with a serrated face. The switch can be a depressible button having a catch portion that interlocks with a catch member adjacent to the hinged end of the legs, wherein depressing the button causes the catch portion to release the catch member allowing the legs to drop out from underneath the fore grip. Behind the switch can be a spring for pushing an outer face of the button to expand outward from a side of the fore grip. The expansion spring in the fore grip can include a torsion spring having each end abutting against an upper inner surface of each leg.

The fore grip can include a generally cylindrical handle for housing the pair of legs with the hinged end, the catch member, the switch and the expansion spring, a screwable cap for covering a bottom opening on the handle having an opening smaller in diameter than the opening in the handle, wherein the cap permits and limits the sliding of the legs from underneath the handle when the legs are deployed. The handle can include a void space or female orifice to hold an accessory switch such as but not limited to a depressible switch, for activating an accessory unit, such as but not limited to a light. A cap cover can cover the void space or female orifice. A tension fit pin can hold the cap cover in place. Each of the legs can include telescoping legs to allow adjustment of the leg lengths for uneven terrain. Each of the legs can include integral molded angled feet formed with a hollow backside and metal reinforcement member. The mount on the fore grip can include members for clamping the fore grip to a weapon, and a screwable member for fastening the rail members about a portion of the weapon.

The fore grip can also include a second spring for causing the legs to drop below the fore grip.

The legs can also drop from fore grip by gravity. Alternatively, inertial actuation (jerking or flipping the fore grip) can result in the legs being deployed downward and then expanded out by an expansion spring.

A novel method of actuating a leg stand from the fore grip on a weapon can include the steps of attaching a generally cylindrical fore grip handle with irregular side surfaces as a fore grip to a weapon, depressing a button located on an upper side surface of the handle, releasing a catch member that supports a pair of hinged legs by the depressing of the button, dropping foot ends of the legs from underneath the handle, and expanding the pair of legs outward relative to the hinged end as the legs leave the handle to a deployed position.

The step of dropping can be by the expanding of a spring against an upper portion adjacent of the hinged ends of the legs in downward direction. The step of dropping can be by releasing the legs downward gravity.

Alternatively, inertial actuation (flipping and jerking motions) can result in the legs dropping out from the fore grip. Also, physically pulling the legs downward after the side switch is activated can be done.

A listing of the fore grip Ball Seat and Stacking Plate designator references for use with the subject canting invention embodiments will now be described.

2 Operator
6 Firearm/Weapon
10 Fore grip.
20 Handle.
22 inside walls of handle
30 Retainer cap.
32 Ledge inside cap
36 Cone shape inner angled edge 36
40 Leg.
50 Ball yoke.
54 Rounded outer walls of yoke
60 Yoke compression spring.
70 Rubber O-ring.
80 Torsion spring.
90 Leg pivot pin.
100 Contact point between retainer cap and legs.
110 Support surface.
120 Handle centerline perpendicular to support surface in resting position.
130 Handle centerline tilted left from resting position.
140 Handle centerline tilted right from resting position.
150 Canting plate
160 Rail clamp.
162 protruding ridge
164 protruding ridge
168 upper inwardly facing clamp edge
170 Forward clamp block.
172 indentation portion
173 E-shaped cut-outs
174 indentation portion
175 locking slot with outer hexagon shape
178 upper inwardly facing clamp edge
180 Aft clamp block.
182 indentation portion

183 Longitudinal through-slot
184 indentation portion
185 locking slot with outer hexagon shape
188 upper inwardly facing clamp edge
190 Tilting rail.
192 Pair of slots on one side of rail
193 Longitudinal side slot
194, 196 angled rail edges
200 Clamp screw.
210 Tilt release button.
220 Pivot nut.
230 Clamp bolt.
240 Pivot shaft.
250 Tilt lock shaft.
260 Tilt release spring.
270 Lock pin collar.
280 Tilt rail lock pin.
290 Lock pin spring.
300 Leaf stud.
310 Tilt leaf spring.
320 Weapon mounting rail
330 Fore Grip
340 Tilt stop pin.

Canting Ball Yoke for Fore Grip

FIG. 1 is a right side view of a ball canting fore grip 10 of the handle 20 with legs 40 extended. Fore grip 10 and legs 40 can be a vertical fore grip with bipod legs such as the one shown and described in the inventor's previous U.S. Pat. No. 7,111,424 to Gaddini, as well as the fore grips shown and described in the inventors U.S. patent application Ser. No. 11/485,762 filed Jul. 13, 2006, and U.S. Design patent application Ser. Nos. 29/267,729 filed Oct. 20, 2006 and 29/259, 347 filed May 5, 2006, all of which are incorporated by reference.

A preferred example of the fore grip 10 with bipod legs 40 is for allowing two legs 40 to be concealable within a fore grip handle, where the legs can drop down and expand into a stand for supporting a firearm 6, such as a rifle, and the like. In the inventor's previous patent, one example of the fore grip included a plurality of legs that are concealed within the fore grip are coupled via a hinge to a spring piston assembly. A spring-loaded fulcrum release mechanism holds the piston assembly in a compressed and locked position. When the piston assembly is released upon activation of the spring-loaded fulcrum release mechanism, the legs are driven downwards by the piston and upon being released from the confinement of the fore grip are deployed outwards to a locked position by a hinge or pivot mechanism. The legs have feet that are designed so that, when the legs are concealed within the handle, the feet seal off the deployment and spreader mechanisms from entrance of any debris, material etc that may interfere with the deployment of the bipod.

Figures 2, 3:
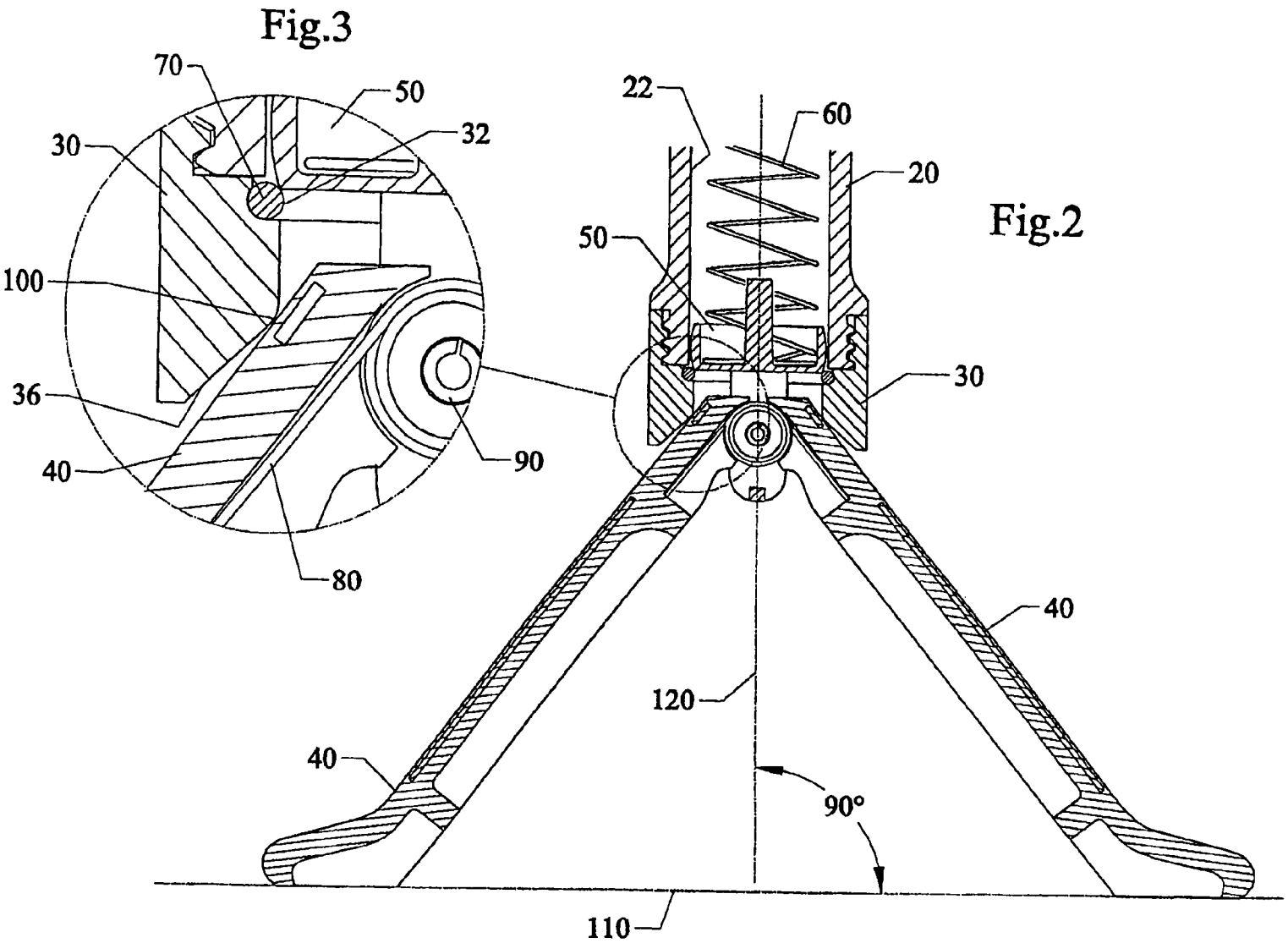
FIG. 2 shows a lower cross-sectional side view of fore grip of FIG. 1 along arrows X showing the modified yoke and retainer cap.
FIG. 3 is an enlarged view of a portion of the canting components of FIG. 2.
Figure 4:
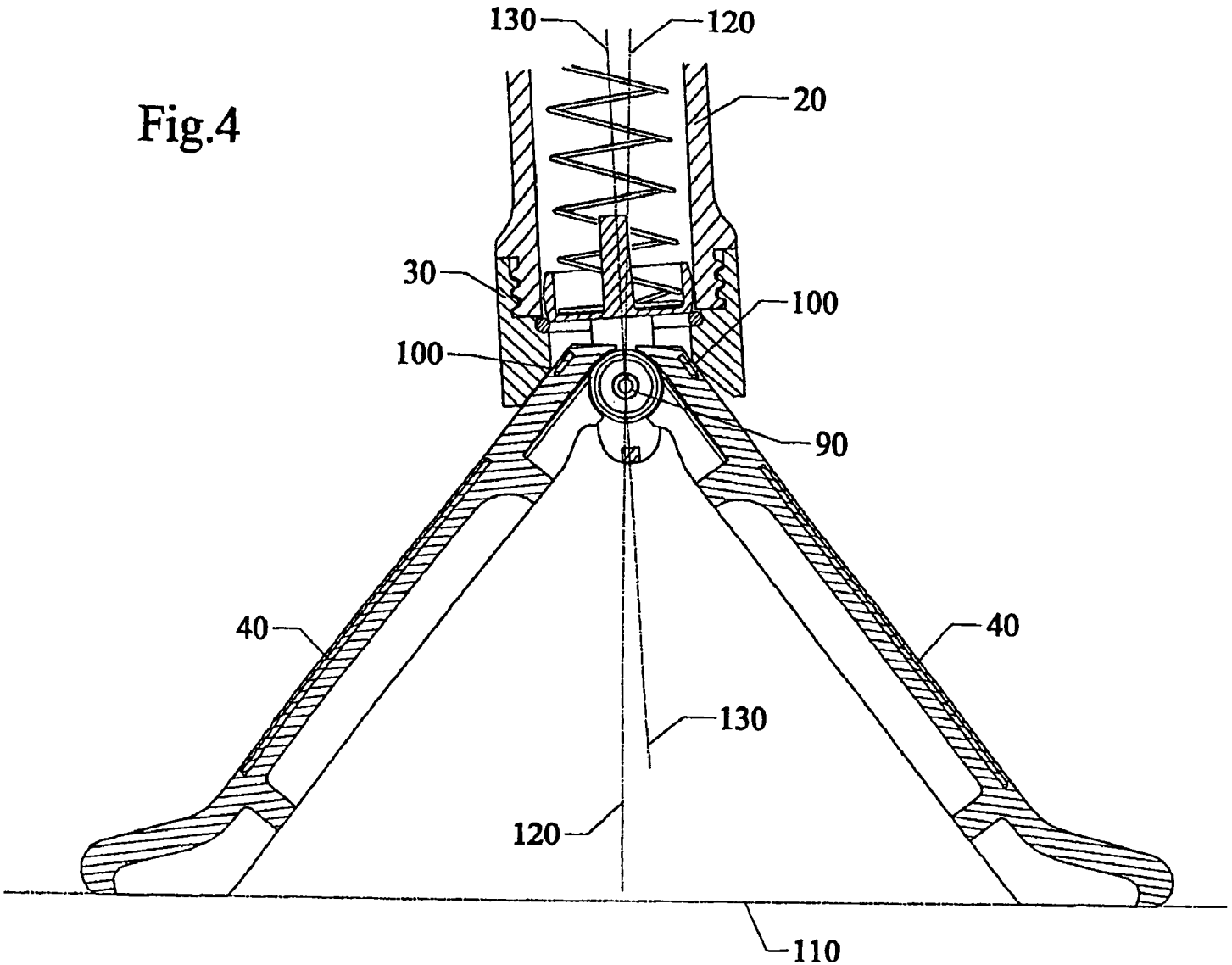
FIG. 4 is another lower cross-sectional view of the fore grip of FIG. 2 showing the fore grip handle tilted to the left.
Figure 5:
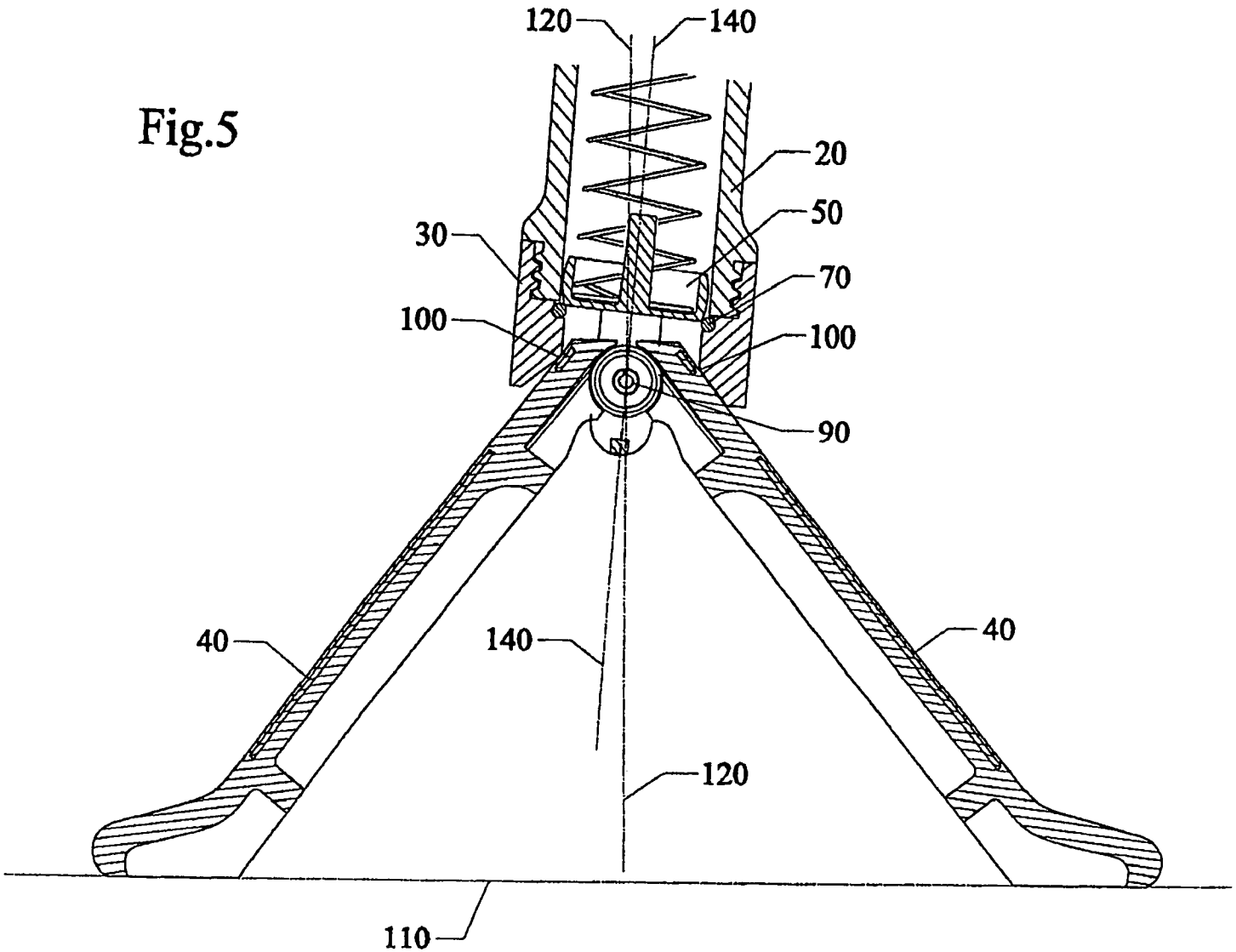
FIG. 5 is another lower cross-sectional view of the fore grip of FIG. 2 showing the fore grip handle tilted to the right.

FIG. 2 shows a lower cross-sectional side view of fore grip 10 of FIG. 1 along arrows X showing the modified yoke and retainer cap. FIG. 3 is an enlarged view of a portion of the canting components 30, 100 of FIG. 2. FIG. 4 is another lower cross-sectional view of the fore grip 10 of FIG. 2 showing the fore grip handle 20 tilted to the left. FIG. 5 is another lower cross-sectional view of the fore grip 10 of FIG. 2 showing the fore grip handle 20 tilted to the right.

Referring to FIGS. 1-5, the novel fore grip 10 is to allow the Handle 20 to cant (lean to the right or to the left) independent of the support Legs 40. This makes the firearm/weapon 6 mount less rigid and provides a limited range of canting or rocking motion to track targets. The novel fore grip 10 includes features of the inventor's previously patented and patent pending fore grips with bipods referenced above with a novel retainer cap 30 and the ball yoke 50

Referring to FIGS. 2-5, the slidable ball yoke 50 can be affixed to legs 40. The Yoke 50 can slide freely up and down the inside of the tubular handle 20 drawing the legs 40 inside and outside of the handle 20 as it slides.

In the inventor's previous patent and patent pending models, a close clearance between the walls 54 of the Yoke 50 and the interior walls 22 of the handle 20 discouraged any radial or "rocking" motion when the legs 40 were deployed. The novel ball yoke 50 shown in FIGS. 2-5 can have rounded convex shaped side walls 54 like a ball, and the like, to allow for a limited "rocking" motion of the yoke 50 when the legs 40 are deployed.

Additionally, a flexible O-ring 70 can be used that can sit on a surface portion of an inner ledge 32 on to the screwable retainer cap 30. The yoke 50 can rest on the O-ring 70 when the legs 40 are deployed. The O-ring 70 can provide a semi-rigid surface for the yoke 50 to move against when the handle 20 cants (leans to the right or to the left).

The retainer cap 30 has also has an inner edge modified to accommodate the "rocking" movement of the yoke 50. In the inventors previous patent and patent pending inventions, the outer upper surface of the legs 40 can seat firmly against the entire inside surface of a "cone" shape machined inside of the retainer cap 30. In the inventor's previous models, this created a very stable assembly where any "rocking" motion was not possible. To allow for a rocking motion this, the "cone" shape inner angled edge 36 machined inside of the retainer cap 30 has been angled to provide a pivotable "point" of contact 100 between the deployed legs 40 and the retainer cap 30. This "point" 100 creates a fulcrum about which the deployed legs 40 can rock and slide in canting motions.

Figure 7:
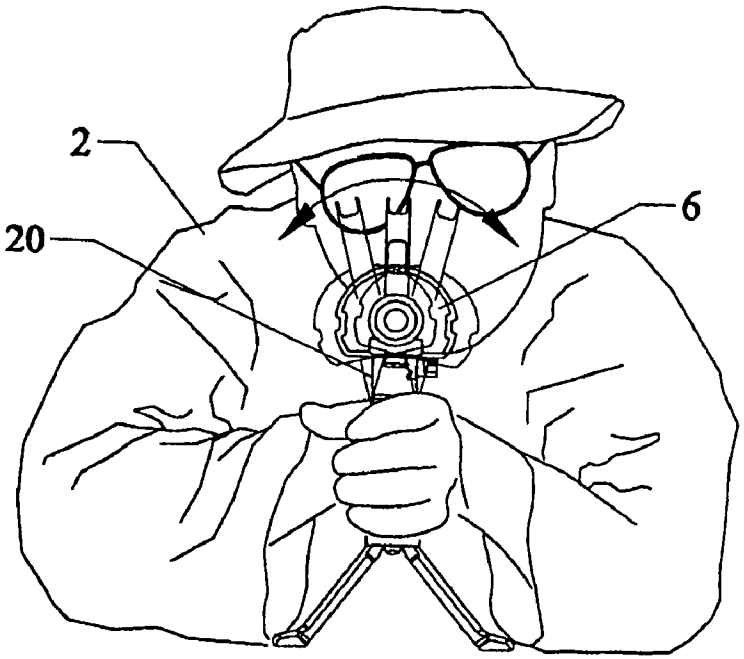
FIG. 7 is another front view of FIG. 6 showing the fore grip handle in canting positions.
Figure 6:
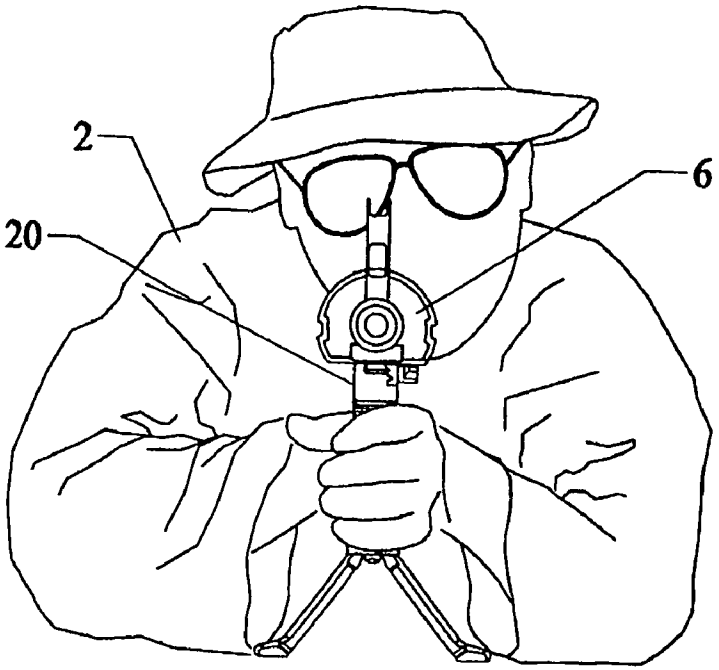
FIG. 6 is a front view of an operator using the fore grip handle of the preceding figures with a firearm, with the fore grip handle in a stationary none canting position.
Figure 12:
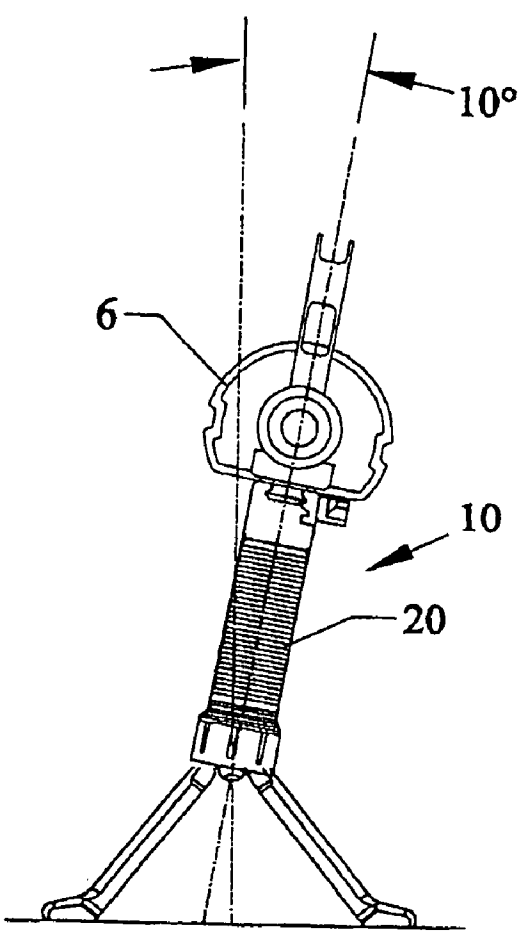
FIG. 12 is another front view of FIG. 10 of the firearm and fore grip canting to the right at approximately ten degrees.
Figure 11:
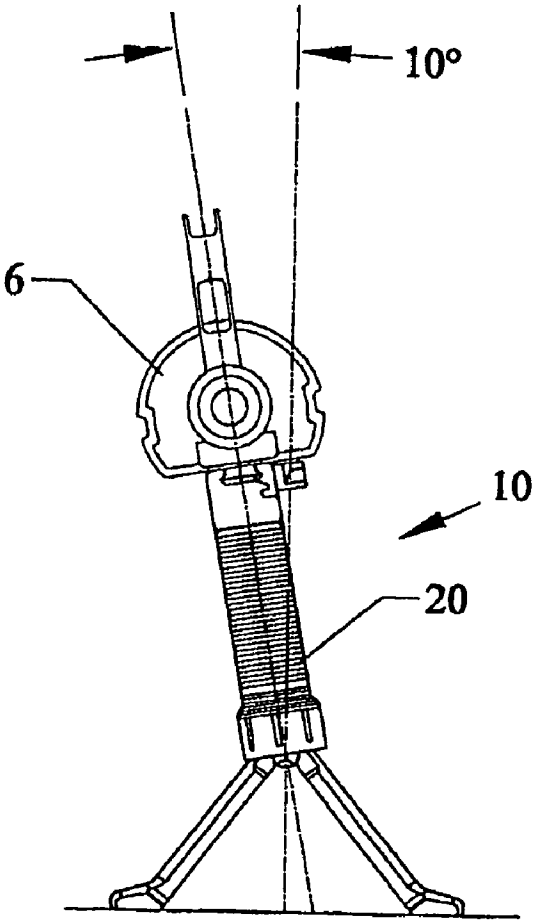
FIG. 11 is another front view of FIG. 10 of the firearm and fore grip canting to the left at approximately ten degrees.
Figure 10:
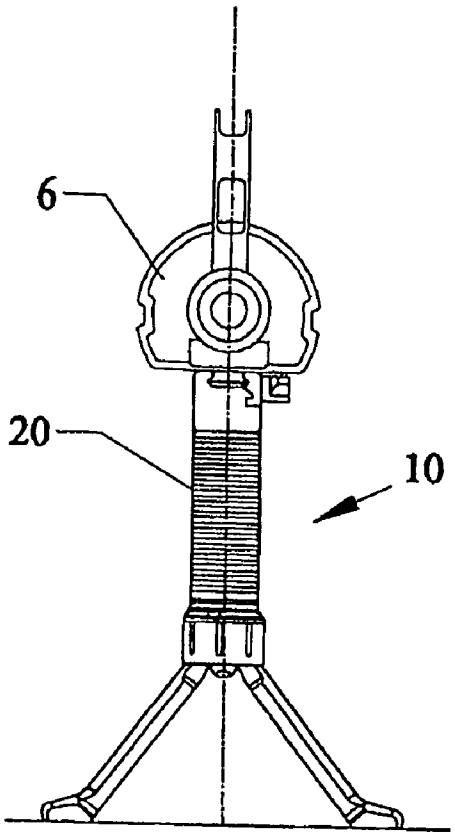
FIG. 10 is a front view of the firearm and fore grip of the preceding figures in a stationary none canting position.

FIG. 6 is a front view of an operator 2 using the fore grip handle 20 of the preceding figures with a firearm 6, with the fore grip handle 20 in a stationary none canting position. FIG. 7 is another front view of FIG. 6 showing the fore grip handle 20 in canting positions. FIG. 8 is a side view of the operator 2 with firearm 6 and fore grip handle 20 in a stationary none canting position. FIG. 9 is another side view of FIG. 8 showing the fore grip handle 20 in canting positions. FIG. 10 is a front view of the firearm 6 and fore grip 10 of the preceding figures in a stationary none canting position. FIG. 11 is another front view of FIG. 10 of the firearm 6 and fore grip 10 canting to the left at approximately ten degrees. FIG. 12 is another front view of FIG. 10 of the firearm 6 and fore grip 10 canting to the right at approximately ten degrees.

The canting components 50, 22, 40, 100, 36 can be loose to allow the operator of the firearm to easily adjust by a "rocking" type motion a desired canting position of the firearm. Alternatively, the canting components can be tightly oriented so that the deployed legs 40 can remain in a generally fixed in a canted position when the operator 2 cants the handle 20 to the left or to the right.

While the above drawing figures show maximum canting degrees of up to approximately 10 degrees, the invention can include greater than approximately 10 degrees.

Although the preferred embodiment is shown for use with the inventors' previous fore grip having bipod legs, the invention can be used with other fore grips with leg stands having two, three or more legs, as needed.

Canting Stacking Plate Fore Grip

Similar to the previous embodiment, this embodiment can also be used with the inventors' previous fore grips, which were disclosed in the inventors previous patent and other patents pending listed above, that are incorporated by reference.

FIG. 13 is a top perspective view of a stacking canting plate 150 for the fore grip 330 (shown in later drawings). FIG. 14 is a front view of the stacking canting plate 150 of FIG. 13. FIG. 15 is a top view of the stacking canting plate 150 of FIG. 13 along arrow T. FIG. 16 is a bottom view of the stacking canting plate 150 of FIG. 1 along arrow B. FIG. 17 is a left side view of the stacking canting plate 150 of FIG. 13 along arrow L. FIG. 18 is a right side view of the stacking canting plate 150 of FIG. 13 along arrow R. FIG. 19 is an exploded perspective view of the stacking canting plate 150 of FIG. 13.

Referring to FIGS. 13-19, the stacking canting plate 150 can include a pair of moveable rail clamps 160 with respective clamp screw tightening knobs 200. The clamps 160 have side protruding ridges 162, 164 that can interlock and mateably attach about indentation portions 172, 174 and 182, 184 on one side of forward clamp block 170 and aft clamp block 180. On the opposite side of forward clamp block 170 can be clamp bolt 230 with threaded end that passes through a locking hole-slot 175 to threadably attach to clamp screw tightening knob 200. On the opposite side of aft clamp block 180 can be another clamp bolt 230 with threaded end that passes through a locking hole-slot 185 to another clamp screw tightening knob 200. The locking hole-slots 175 and 185 can have a hexagon shape so as to receive the hexagon head of clamp bolts 230.

On a side wall of forward clamp block can be an E shaped cut-outs that appears to be on its' back, with the upper(left) and lower(right) cut-out grooves of the E being substantially identical, and the middle cut-out groove having a generally circular shape.

Sandwiched between side facing walls of the forward clamp block 170 and aft clamp block 180 can be an elongated tilting rail 190. The tilting rail 190 can include tilt stop pins 192 having one end inserted partially into mateable sized slots 192 of on one end of the tilt rail 190, and the opposite ends of the pins 192 protruding into the left and right cut-out grooves of the E shaped cut-out so that the pins can move slightly up or down in the respective left and right cut-out grooves. The operation of these features are further described and shown in reference to FIGS. 27-29.

Referring to FIGS. 13-19, inside of a longitudinal slot 195 in tilting rail 190 can be a pivot shaft 240 which can be a generally elongated rod with threaded ends 241, 249 extending out both ends of the tilting rail 190. One threaded end 241 can pass through the middle cut-out groove of the E-shaped cut-out 173 and be threadably attached to a pivot nut 220 on an opposite outer wall of the forward clamp block 170. The opposite threaded end 249 of the pivot shaft 240 can be threadably attached to another pivot nut 220 on an opposite side of the aft clamp block 180. A tilt leaf spring 310 such as a flat straight piece of bendable metal can be positioned in the back cut-out portion of the E shaped cut-out 173 so that a forward end portion 242 of the pivot shaft 240 rests on the leaf spring 310. The operation of these features is shown and described in reference to FIGS. 27-29.

Referring to FIGS. 13-19, located in longitudinal side slot 193 of the tilting rail 190 can be a lock spin spring 290 which has an outer end that abuts against a tilt rail lock pin 280. Inside of a longitudinal through-slot 183 of the aft clamp block 180 can be a lock pin collar 270 tilt lock shaft 250, tilt release spring 260 and tilt/canting release button 210. The operation of these features is described in reference to FIGS. 30-33.

FIG. 20 is an exploded perspective view of a bottom portion of a firearm 6 having weapon mounting rail 320 that can be generally an upside down elongated T-shape, that is separated from both the stacking canting plate 150 and the fore grip 330. The fore grip can one a concealable and collapsible bipod such as the one labeled fore grip 10 in the preceding figures, and which is further described in the inventors' previous patent and other patents pending referenced above, that are all incorporated by reference.

FIG. 21 is another perspective view of the fore grip 330 clamped to the stacking canting plate 150, which are separated from the firearm lower mounting rail 320. Referring to FIGS. 13-19 and 21, the upper mount portion on the fore grip 330 can include grippable clamp members 332, 334 for clamping the fore grip 330 about the angled rail edges 194, 196 on opposite sides of the tilting rail 190 of the stacking canting plate 150. A screwable knob type member 335 can lock the fore grip 330 to the stacking canting plate 150.

FIG. 22 is a perspective assembled view of the stacking canting plate 150 clamped to both the firearm lower rail 320 and the fore grip 330. Referring to FIGS. 13-19 and 22, the upper inwardly facing clamp edges of the forward clamp block 170 and the aft clamp block 180 can grip about one side edge of the weapon mounting rail 320. The upper inwardly facing clamp edges 168 of both rail clamps 160 can grip about the opposite side edge of the weapon mounting rail 320 with knobs/screws 200 tightened to lock the canting stacking plate 150 to the firearm 6.

FIG. 23 is an end view of the assembled stacking canting plate 150 and firearm lower rail 320 and fore grip 330 of FIG. 22 where the firearm 6 is in an upright vertical (neutral) position. FIG. 24 is another end view of the assembled stacking canting plate 150 and firearm lower rail 320 and fore grip 330 of FIG. 22 with the firearm 6 canting to the left. FIG. 25 is another end view of the assembled stacking canting plate 150 and firearm lower rail 320 and fore grip 330 of FIG. 22 with the firearm 6 canting to the right.

FIG. 26 is another top view of an enlarged stacking canting plate 150 of FIG. 15. FIG. 27 is a cross-sectional right side view of the stacking canting plate 150 of FIG. 26 along arrows XX when the firearm 6 of FIG. 23 is in a vertical(neutral) position. FIG. 28 is another cross-sectional right side view of the stacking canting plate 150 of FIG. 26 when the firearm 6 of FIG. 24 is canting to the left. FIG. 29 is another cross-sectional right side view of the stacking canting plate 150 of FIG. 26 when the firearm 6 of FIG. 25 is canting to the right.

The operation of canting (leaning to the left, and leaning to the right) will now be described. Referring to FIGS. 13, 19, and 23-29, left and right tilt stop pins 340 that are fixably positioned by tilting rail 190 can move up and down in the outer vertical cut-out slots of E-shaped cut-out 173.

Canting to the left will now be described. Referring to FIGS. 13, 19, 23, 24, 27 and 28, the tilt leaf spring 310 is pushed down on the right side by right tilt stop pin 340, which is pressed in the tilt rail. The tilt leaf spring 310 then wants to return the tilt rail 190 to the neutral position.

Canting to the right will now be described. Referring to FIGS. 13, 19, 23, 25, 27 and 29, the tilt leaf spring 310 is being pushed down on the left side by the left tilt stop pin 340, which is pressed into the tilt rail 190. The tilt leaf spring 310 then wants to return the tilt rail 190 to the neutral position.

FIG. 30 is a partial upper right cross-sectional view of the stacking canting plate 150 of the preceding figures with cant release button 210 in an extended out canting-lock position. FIG. 31 is a cross-sectional view of the partial stacking canting plate 150 of FIG. 30 along arrows SS.

Referring to FIGS. 30-31, the "out" position of the tilt release button 210 indicates the tilt rail 190 is locked in the neutral position previously shown and described in reference to FIGS. 23, and 27. In this position, the tilt rail lock pin 280 is extended into the aft clamp block 180, where this configuration locks the tilt rail 190 in the neutral position. In the lock position, the firearm 6 and canting plate 150 and fore grip 330 are in a fixed orientation to one another where no canting (leaning/twisting) can take place.

FIG. 32 is a partial upper right cross-sectional view of the stacking canting plate 150 of FIG. 30 with cant release button 210 in a depressed canting-release position. FIG. 33 is a cross-sectional view of the partial stacking canting plate 150 of FIG. 32 along arrows ST.

Referring to FIGS. 32-33, the "in" depressed position of the tilt release button indicates that the tilt rail 190 is unlocked. Here, the tilt rail lock pin is being pushed into the tilt rail 190 by the tilt lock shaft 250 where this configuration releases the tilt rail 190 to be able to cant to the left or to the right. For the unlock position, the operator must constantly always depress button 210 to allow the canting effects.

Once button 210 is released, spring 290 will expand and move tilt rail lock pin 280 through lock pin collar 270 and into aft clamp block 180, and spring 260 will move tilt lock shaft 250 and extend button 210 to an extended lock position. Again, depressing button 210 moves these components in the opposite direction.

The canting stacking plate components can be loose to allow the operator of the firearm to easily adjust by a "rocking" type motion a desired canting position of the firearm. Alternatively, the canting components can be tightly oriented so that the deployed legs of the fore grip can remain in a generally fixed in a canted position when the operator 2 cants the fore grip to the left or to the right.

While the above drawing figures show maximum canting degrees of up to approximately 10 degrees, the invention can include greater than approximately 10 degrees.

Although the preferred embodiment is shown for use with the inventors' previous fore grip having bipod legs, the invention can be used with other fore grips with leg stands having two, three or more legs, as needed.

Although the invention describes limiting the rocking motion to canting (leaning to the left and to the right), the invention can be deployed so that the weapon can tilt forward and backward, which is perpendicular to canting the firearm.

Also, the invention canting mounts can also allow the weapon to rotate in vertical neutral positions. The invention will also allow for rotating the weapon while the weapon is canting or tilting.

The invention can be useful to accommodate weapons for uneven terrain, such as a hill, rocky terrain and the like. The invention allows for the weapon to be supported on the terrain in one location to fire different shots at different orientations (up, down, to the left, to the right, on all axes, rotational axes, different combinations, and the like) without moving the legs supporting the weapon. Setting-up time and shot accuracy is greatly improved, by allowing a marksman to engage targets in a wide range of locations without having to physically change the position of the weapon support legs.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A method of canting a firearm weapon on a support stand, comprising the steps of:

providing an elongated vertical handle having an upper end, and a lower end with a pair of legs with a pivotally attached upper end substantially within the handle;

providing a canting plate member on the upper end of the vertical handle having upper facing adjustable parallel clamp members mounting a firearm to the upper end of the canting plate member expanding the pair of legs to a bipod configuration of expanded legs for supporting the firearm above a surface; and canting the firearm with the canting plate member to the right and the left relative to the legs, wherein the canting step includes the steps of:

clamping an upper member to a top portion of a fore grip and to a lower mounting rail on the firearm; and pivoting a portion of the clamped upper member relative to another portion of the clamped upper member.

2. The method of claim 1, wherein the canting step includes the step of rocking the firearm up to approximately ten degrees to the right and up to approximately ten degrees to the left.

3. The method of claim 1, wherein the canting step includes the step of limiting right canting up to approximately 10 degrees; and limiting left canting up to approximately ten degrees to the left.

4. The method of claim 1, wherein the clamping step includes the step of contracting a screwable component about the mounting rail of the firearm.

5. The method of claim 1, wherein the canting step includes the step of providing a tilt rail that is clamped by the upper end of the handle.

6. The method of claim 5, wherein the step of providing the tilt rail includes the step of:

springably supporting the firearm in a vertical upright and noncanting position with the tilt rail being spring biased.

7. The method of claim 1, further comprising the steps of:

providing a spring biased button on the handle, having an extended position and a depressed position;

locking the firearm in a vertical upright and noncanting position when the spring biased button is in the extended position; and depressing the button which allows the firearm to be capable of canting to the right and the left relative to the legs.

8. The method of claim 1, wherein the firearm is a rifle.

9. The method of claim 1, further comprising the step of:

providing at least one opening inside the vertical handle.

10. The method of claim 1, further comprising the steps of:

holding the legs inside of the vertical handle with a catch; and dropping the legs out from beneath the vertical handle with a release.

11. The method of claim 1, further comprising the step of:

expanding the legs to pivot outward beneath the vertical handle to form an upside down V configuration with an expansion member.

12. A method of canting a firearm weapon on a support stand, comprising the steps of:

providing an elongated vertical handle having an upper end, and a lower end with a pair of legs with a pivotally attached upper end substantially within the handle;

providing a canting plate member on the upper end of the vertical handle having upper facing adjustable parallel clamp members mounting a firearm to the upper end of the canting plate member expanding the pair of legs to a bipod configuration of expanded legs for supporting the firearm above a surface; and canting the firearm with the canting plate member to the right and the left relative to the legs, wherein the canting step includes the step of:

limiting right canting up to approximately 10 degrees; and limiting left canting up to approximately ten degrees to the left.

13. A method of canting a firearm weapon on a support stand, comprising the steps of:

providing an elongated vertical handle having an upper end, and a lower end with a pair of legs with a pivotally attached upper end substantially within the handle;

providing a canting plate member on the upper end of the vertical handle having upper facing adjustable parallel clamp members mounting a firearm to the upper end of the canting plate member expanding the pair of legs to a bipod configuration of expanded legs for supporting the firearm above a surface; and canting the firearm with the canting plate member to the right and the left relative to the legs, wherein the canting step includes the step of:

providing a tilt rail that is clamped by the upper end of the handle.

14. A method of canting a firearm weapon on a support stand, comprising the steps of:

providing an elongated vertical handle having an upper end, and a lower end with a pair of legs with a pivotally attached upper end substantially within the handle;

providing a canting plate member on the upper end of the vertical handle having upper facing adjustable parallel clamp members mounting a firearm to the upper end of the canting plate member expanding the pair of legs to a bipod configuration of expanded legs for supporting the firearm above a surface;

providing a spring biased button on the handle, having an extended position and a depressed position;

locking the firearm in a vertical upright and noncanting position when the spring biased button is in the extended position;

depressing the button which allows the firearm to be capable of canting to the right and the left relative to the legs; and canting the firearm with the canting plate member to the right and the left relative to the legs.

15. A method of canting a firearm weapon on a support stand, comprising the steps of:

providing an elongated vertical handle having an upper end, and a lower end with a pair of legs with a pivotally attached upper end substantially within the handle;

providing a canting plate member on the upper end of the vertical handle having upper facing adjustable parallel clamp members mounting a firearm to the upper end of the canting plate member expanding the pair of legs to a bipod configuration of expanded legs for supporting the firearm above a surface;

canting the firearm with the canting plate member to the right and the left relative to the legs;

holding the legs inside of the vertical handle with a catch; and dropping the legs out from beneath the vertical handle with a release.

* * * * *